US010212523B2

(12) United States Patent
Paludan-Muller et al.

(10) Patent No.: US 10,212,523 B2
(45) Date of Patent: Feb. 19, 2019

(54) HEARING AID SYSTEM AND A METHOD OF OPERATING A HEARING AID SYSTEM

(71) Applicant: Widex A/S, Lynge (DK)

(72) Inventors: Carsten Paludan-Muller, Frederikssund (DK); Anne Vikar Damsgaard, Ganlose (DK); Morten Love Jepsen, Frederiksberg C (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 15/381,220

(22) Filed: Dec. 16, 2016

(65) Prior Publication Data

US 2017/0180881 A1 Jun. 22, 2017

(30) Foreign Application Priority Data

Dec. 18, 2015 (DK) ..... 2015 00821

(51) Int. Cl.
*H04R 25/00* (2006.01)
*G10L 25/78* (2013.01)

(52) U.S. Cl.
CPC ..... *H04R 25/505* (2013.01); *G10L 25/78* (2013.01); *H04R 25/356* (2013.01); *H04R 25/552* (2013.01); *H04R 2225/41* (2013.01); *H04R 2225/43* (2013.01); *H04R 2430/03* (2013.01)

(58) Field of Classification Search
CPC ..... H04R 2225/41; H04R 2225/42; H04R 2430/03; H04R 25/356; H04R 25/505; H04B 17/30; H04B 17/345; G10L 25/84
USPC ..... 381/312–320
See application file for complete search history.

(56) References Cited

U.S. PATENT DOCUMENTS 6,236,731 B1 * 5/2001 Brennan ..... H03H 17/0266 381/312
8,908,892 B2 * 12/2014 Bauml ..... H04R 25/353 381/316
2008/0144869 A1 * 6/2008 Paludan-Mueller ..... H04R 25/356 381/320

* cited by examiner

*Primary Examiner* — Sunita Joshi
(74) *Attorney, Agent, or Firm* — Sughrue Mion, PLLC

(57) ABSTRACT

A method of operating a hearing aid system (400) based on processing two groups of interleaved frequency bands such that one of the two groups of frequency bands is attenuated with respect to the other and such that it alternates with time whether one or the other of the two groups are attenuated and a hearing aid system (100, 200, 300) for carrying out the method.

16 Claims, 4 Drawing Sheets

HEARING AID SYSTEM AND A METHOD OF OPERATING A HEARING AID SYSTEM

RELATED APPLICATIONS

The present application is based on and claims priority from PA 201500821, filed on Dec. 18, 2015, in Denmark, the contents of which are incorporated herein by reference.

BACKGROUND OF THE INVENTION

1. Field of the Invention

The present invention relates to hearing aid systems. The present invention also relates to a method of operating a hearing aid system and a non-transitory computer-readable medium storing instructions thereon, which when executed by a computer perform the method.

Generally a hearing aid system according to the invention is understood as meaning any system which provides an output signal that can be perceived as an acoustic signal by a user or contributes to providing such an output signal, and which has means which are used to compensate for an individual hearing deficiency of the user or contribute to compensating for the hearing deficiency of the user. These systems may comprise hearing aids which can be worn on the body or on the head, in particular on or in the ear, and can be fully or partially implanted. However, some devices whose main aim is not to compensate for a hearing deficiency may also be regarded as hearing aid systems, for example consumer electronic devices (televisions, hi-fi systems, mobile phones, MP3 players etc.) provided they have, however, measures for compensating for an individual hearing deficiency.

Within the present context a hearing aid may be understood as a small, battery-powered, microelectronic device designed to be worn behind or in the human ear by a hearing-impaired user.

Prior to use, the hearing aid is adjusted by a hearing aid fitter according to a prescription. The prescription is based on a hearing test, resulting in a so-called audiogram, of the performance of the hearing-impaired user's unaided hearing. The prescription may be developed to reach a setting where the hearing aid will alleviate a hearing deficiency by amplifying sound at frequencies in those parts of the audible frequency range where the user suffers a hearing deficit.

A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear. For this type of traditional hearing aids the mechanical design has developed into a number of general categories. As the name suggests, Behind-The-Ear (BTE) hearing aids are worn behind the ear. To be more precise, an electronics unit comprising a housing containing the major electronics parts thereof is worn behind the ear and an earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Within the present context a hearing aid system may comprise a single hearing aid (a so called monaural hearing aid system) or comprise two hearing aids, one for each ear of the hearing aid user (a so called binaural hearing aid system). Furthermore the hearing aid system may comprise an external device, such as a smart phone having software applications adapted to interact with other devices of the hearing aid system, or the external device alone may function as a hearing aid system. Thus within the present context the term "hearing aid system device" may denote a traditional hearing aid or an external device.

2. The Prior Art

It is well known for persons skilled in the art of hearing aid systems that some hearing aid system users are not satisfied with results of conventional hearing-aid fitting that primarily is based on a measurement of an elevated hearing threshold.

A subgroup of potential hearing aid users are assumed to have auditory-nerve dysfunction (that may also be denoted auditory neurodegeneration) due to aging or ototoxic drug exposure or noise trauma. This type of hearing deficit is typically not diagnosed as part of a traditional hearing aid fitting and consequently few, if any, methods of operating hearing aid systems in order to relieve this type of hearing deficit are available.

It is therefore a feature of the present invention to suggest a method of operating a hearing aid system in order to provide hearing-aid sound processing that can benefit individuals with an auditory-nerve dysfunction.

It is another feature of the present invention to suggest a hearing aid system adapted to carry out a sound processing method that can benefit individuals with an auditory-nerve dysfunction.

SUMMARY OF THE INVENTION

The invention, in a first aspect, provides a method of operating a hearing aid system, the method comprising the steps of providing an electrical input signal representing an acoustical signal from an input transducer of the hearing aid system, splitting the input signal into a plurality of frequency bands, forming a first group of frequency bands and a second group of frequency bands, wherein the first group of frequency bands comprises frequency bands that are interleaved with respect to frequency bands comprised in the second group of frequency bands, alternating between selecting the first group of frequency bands or the second group of frequency bands, processing the selected frequency bands in a first manner, hereby providing processed selected frequency bands, processing the non-selected frequency bands in a second manner such that the non-selected frequency bands are attenuated relative to the selected frequency bands, hereby providing processed non-selected frequency bands, providing an output signal based on the processed selected and non-selected frequency bands, and using the output signal to drive an output transducer of the hearing aid system.

The invention, in a second aspect, provides a non-transitory computer-readable medium storing instructions thereon, which when executed by a computer perform the following method, the method comprising the steps of providing an electrical input signal representing an acoustical signal from an input transducer of the hearing aid system, splitting the input signal into a plurality of frequency bands, forming a first group of frequency bands and a second group of frequency bands, wherein the first group of frequency bands comprises frequency bands that are interleaved with respect to frequency bands comprised in the second group of frequency bands, alternating between selecting the first group of frequency bands or the second group of frequency bands, processing the selected frequency bands in a first manner, hereby providing processed selected frequency bands, processing the non-selected frequency bands in a second manner such that the non-selected frequency bands are attenuated relative to the selected frequency bands, hereby providing processed non-selected frequency bands, providing an output signal based on the processed selected and non-selected frequency bands, and using the output signal to drive an output transducer of the hearing aid system.

The invention, in a third aspect, provides a hearing aid system comprising a first hearing aid comprising an input transducer adapted to provide an input signal, a filter bank adapted to split the input signal into a plurality of frequency bands, a frequency band selector adapted to provide a first group of frequency bands and a second group of frequency bands, wherein the first group of frequency bands comprises frequency bands that are interleaved with respect to frequency bands comprised in the second group of frequency bands, and adapted to select either the first or the second group of frequency bands, a digital signal processor adapted for processing the selected frequency bands in a first manner, hereby providing processed selected frequency bands, and adapted for processing the non-selected frequency bands in a second manner such that the non-selected frequency bands are attenuated relative to the selected frequency bands, hereby providing processed non-selected frequency bands, a timing circuit adapted to determine the timing of the frequency band selector to alternate between selecting the first group of frequency bands 5 or the second group of frequency bands; and an output transducer adapted for providing an acoustical output signal based on the processed selected frequency bands and based on the processed non-selected frequency bands.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention. Accordingly, the drawings and descriptions will be regarded as illustrative in nature and not as restrictive. In the drawings.

DETAILED DESCRIPTION OF THE INVENTION

Figure 1:
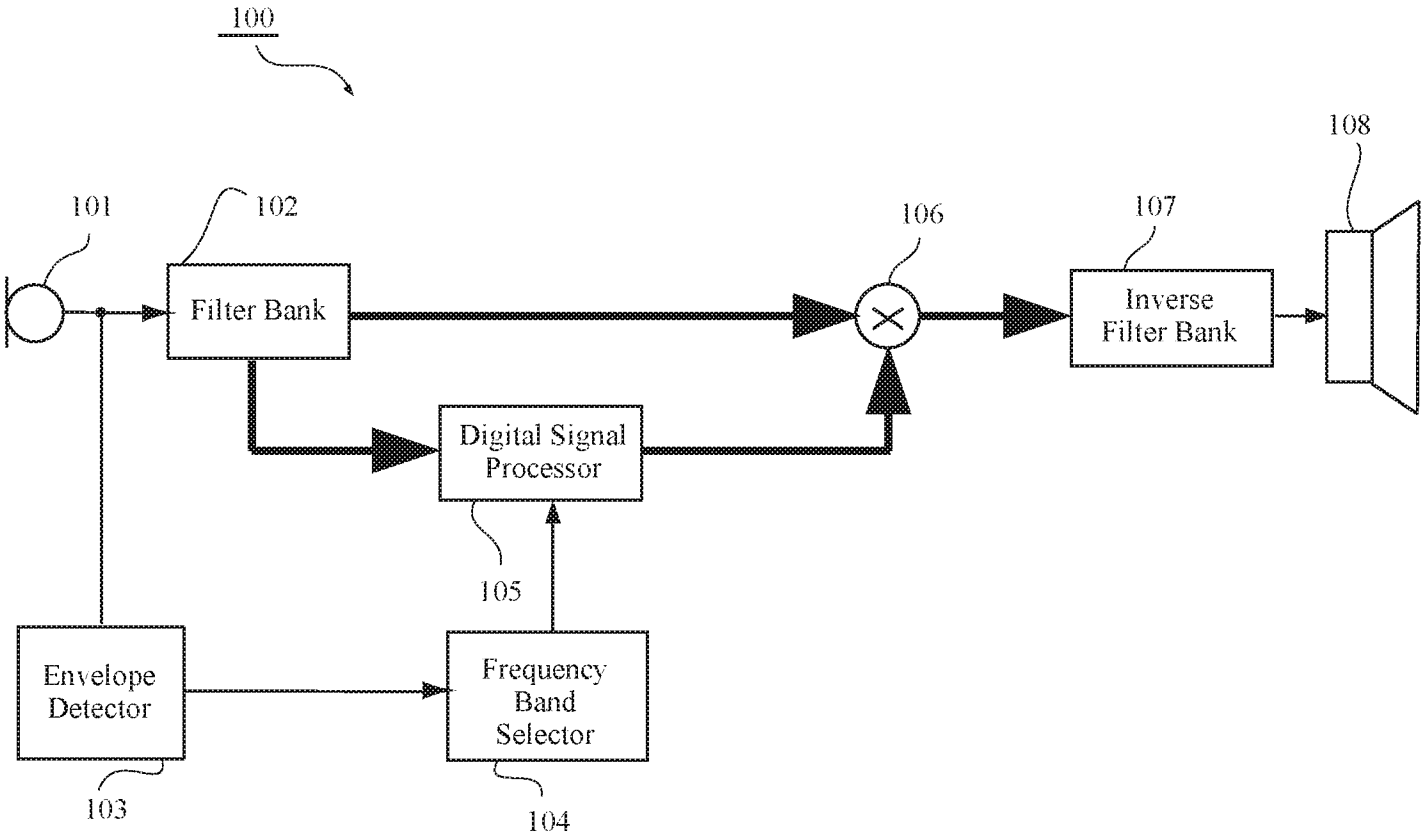
FIG. 1 illustrates highly schematically a hearing aid according to a first embodiment of the invention.

Reference is now made to FIG. 1, which illustrates highly schematically a hearing aid 100 according to a first embodiment of the invention. The hearing aid 100 comprises an acoustical-electrical input transducer 101, a filter bank 102, an envelope detector 103, a frequency band selector 104, a digital signal processor 105, a gain multiplier 106, an inverse filter bank 107 and an electrical-acoustical output transducer 108.

Figure 2:
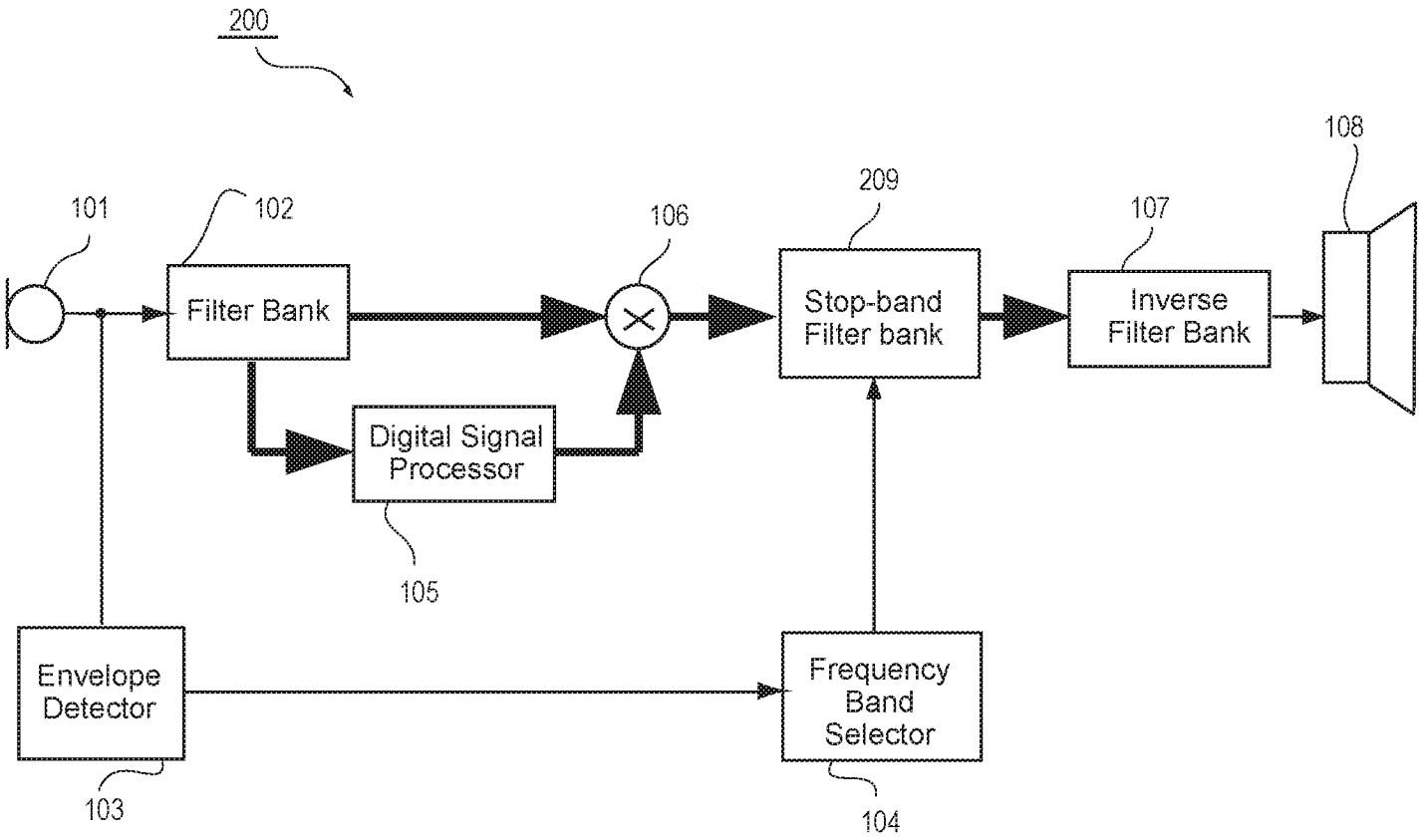
FIG. 2 illustrates highly schematically a hearing aid according to a second embodiment of the invention.

The acoustical-electrical input transducer 101 provides a broadband input signal that is branched and provided to both the filter bank 102 and the envelope detector 103. The filter bank 102 splits the broadband input signal into a plurality of frequency band signals and provides these to the digital signal processor 105, which determines gains to be applied to the respective frequency bands. In FIG. 1 and FIG. 2 the plurality of frequency bands are illustrated by bold lines. In the following the broadband input signal may also simply be denoted input signal and the frequency band signals may also simply be denoted frequency bands. The determined gains are applied to the frequency bands by the gain multiplier 106, hereby providing processed frequency bands that are combined in the inverse filter bank 107, wherefrom an output signal is provided to the electrical-acoustical output transducer 108.

According to the first embodiment the digital signal processor 105 is adapted to compensate a hearing loss of an individual hearing aid user by providing for each frequency band an appropriate gain as a function of frequency band signal level. This functionality is well known within the art of hearing aid systems and the term compressor may also be used for a component providing this type of functionality. Furthermore it is well known for a person skilled in the art that the number of available frequency bands may vary between say 3 and up to say 2048.

The envelope detector 103 determines an envelope of the input signal and provides the envelope of the input signal to the frequency band selector 104. According to the present embodiment the envelope of the input signal is extracted by using a Hilbert transform, which is a method well known for the skilled person.

However, other methods of envelope detection are well known within the art of hearing aid systems and in variations envelope detection may be achieved by half-wave rectification followed by low-pass filtering of the input signal.

The frequency band selector 104 uses the envelope of the input signal to identify a pause between syllables (in the following this may also be denoted detecting a pause between syllables). According to the present embodiment this is done by monitoring the envelope of the input signal and in case the level of the envelope is at a minimum or below a first threshold level for a first minimum duration of time then a pause between syllables is identified. The first threshold level may be 10% of the maximum envelope magnitude or be selected from a range between 5% and 20% of the maximum envelope magnitude. The first minimum duration of time may be selected from a range between 1 millisecond and 50 milliseconds or from the range between 1 and 10 milliseconds or even from the range between 1 and 5 milliseconds. Further, according to the present embodiment, a subsequent detection of a pause between syllables is allowed only if a second minimum duration of time has elapsed since the previous detection of a pause between syllables. The second minimum duration of time that must have elapsed since the previous detection of a pause between syllables may be in the range between 10 milliseconds and 10 000 milliseconds, or in the range between 100 milliseconds and 300 milliseconds, or in the range between 150 milliseconds and 250 milliseconds.

In a variation a subsequent detection of a pause between syllables is allowed only if a third minimum duration of time has elapsed wherein the envelope level is above a second threshold.

In further variations generally any method for identifying a pause between syllables may be applied as part of the present invention. However, the methods disclosed above are advantageous in that they are simple to implement and therefore processing efficient. Alternative methods for identifying a pause between syllables will be well known for a person skilled in the art.

In response to an identification of a pause between syllables the frequency band selector 104 alternates between selecting a first group of frequency bands and a second group of frequency bands. It is advantageous to alternate in response to the identification of a pause because this will make the change of the selected group of frequency bands and hereby the change of processing less audible.

According to the present embodiment the first group of frequency bands comprises frequency bands that are interleaved with respect to frequency bands comprised in the second group of frequency bands. Thus according to an embodiment the frequency bands generally covering the entire processed signal frequency range are numbered in consecutive order according to the frequency content, and the first group of frequency bands then holds the odd numbered frequency bands, while the second group of frequency bands holds the even numbered frequency bands. In a variation not all the frequency bands are interleaved, whereby e.g. at least two consecutively numbered frequency bands are comprised in the same group of frequency bands. In another variation at least one of the frequency bands is not part of either of the two frequency groups, whereby such a frequency band may be processed consistently as opposed to the other frequency bands that are processed differently dependent on whether they are selected or not. This variation may especially be advantageous in case of individuals suffering from frequency ranges with basically no residual hearing (this may also be denoted dead regions) or in case of individuals suffering from frequency ranges where the hearing is highly distorted, since individuals with this type of hearing deficiency will have no benefit from receiving sounds within this frequency range.

According to a more specific variation it may be that a frequency band is alternated between being selected or not by one hearing aid of a binaural hearing aid system while being processed consistently by the other hearing aid of the binaural hearing aid system. This may especially be advantageous in case a hearing deficiency such as a dead region or a high distortion frequency range is only present at one ear of the individual user or the hearing deficiency is at least highly asymmetrical.

Thus, according to the first embodiment the selected frequency bands are processed in a first manner while the non-selected frequency bands are processed in a second manner such that the non-selected frequency bands are attenuated relative to the selected frequency bands in order to obtain that the output signal levels provided by the non-selected frequency bands are not within a range of output levels wherein the user suffers from an auditory neurodegeneration.

According to a specific variation this means that the non-selected frequency bands are attenuated such that the provided output level in dB SPL within a critical frequency band (i.e. a Bark band) is below a threshold level selected from the range between 30 dB SPL and 50 dB SPL.

The various processing manners are implemented in the digital signal processor 105 but the timing of the alternating switching between the various processing manners is controlled by at timing circuit comprised in the frequency band selector 104.

According to the first embodiment the frequency band selector 104 additionally receives input from a speech detector (not illustrated in FIG. 1 for clarity reasons) adapted to estimate whether speech is present or not. In case speech is estimated to be present, the frequency band selector 104 will operate as described above, and when speech is estimated not to be present, then a predetermined switching period decides when to alternate between selecting the first and the second group of frequency bands. The predetermined switching period is selected from a range between 100 milliseconds and 10 000 milliseconds, or between 100 milliseconds and 300 milliseconds or more preferably from a range between 150 milliseconds and 250. These periods are advantageous because they match the auditory nerve refractory period (i.e. the recovery period). The advantage of this match lies in the fact that the auditory nerve is given sufficient time to recover while at the same time keeping the amount of signal information that is lost as low as possible, because the amount of signal information, which is directed to the auditory nerves that are responsive to a given frequency band, are strongly attenuated in the periods where the frequency band is not selected.

However, in a variation of the first embodiment the alternating switching is disabled when speech is not estimated to be present in the sound environment.

In another variation the alternating switching is set to a predetermined switching period selected from a range between 100 milliseconds and 10 000 milliseconds, or selected from a range between 100 milliseconds and 300 milliseconds or preferably from the range between 150 milliseconds and 250 milliseconds independent on whether speech is present or not in the sound environment, and in this case neither an envelope detector nor a speech detector are required for controlling the alternating switching.

According to another variation the digital signal processor 105 is not adapted to compensate a hearing loss of an individual suffering from an elevated hearing threshold, since hearing deficiencies such as auditory-nerve dysfunction are not necessarily accompanied by an elevated hearing threshold.

Reference is now made to FIG. 2 that illustrates highly schematically a hearing aid 200 according to a second embodiment of the invention. FIG. 2 comprises components similar to those of FIG. 1 (and for these components the numbering is kept the same as in FIG. 1) except for a stop-band filter bank 209.

The stop-band filter bank 209 comprises a stop-band filter for a plurality of the frequency bands, and the stop band filters are switched into (i.e. activated) or out (i.e. de-activated) from the individual frequency bands with a timing determined by the frequency band selector, as disclosed with reference to FIG. 1.

The embodiment of FIG. 2 is advantageous over the embodiment of FIG. 1, in that the digital signal processor 105 may be implemented in a more a simple manner, since it needs not be adapted to provide two different gain settings for each of the frequency bands dependent on whether the frequency bands are selected or not. Furthermore the band stop filters of the filter bank may be better suited for high gain suppression in the non-selected frequency bands.

In a variation of the FIG. 2 embodiment the stop-band filter bank 209 comprises more than one stop-band filter for a plurality of the frequency bands in order to suppress signal spill-over from neighboring frequency bands. Thus according to this variation also selected frequency bands will comprise activated band-stop filters adapted to suppress signal spill-over to a neighboring and unselected frequency band. This embodiment is especially advantageous when the number of frequency bands is relatively small, and the filter bank band-pass filters correspondingly broad. The number of frequency bands may be considered small when it is say less than or equal to 32, or less than 24 wherein 24 is the number of the so called critical bands, that are also denoted the Bark bands.

It is well known within the art of hearing aid systems to use the terms critical bands or auditory filters when referring to the auditory filtering provided by the cochlea.

In a further variation of the embodiments of FIG. 1 and FIG. 2 and their corresponding variations the number of available frequency bands are selected to be in the in the range between 8 and 32, or more preferably in the range between 10 and 28, or most preferably 24, since this corresponds to the number of the so called auditory critical bands provided by the cochlea.

It is suspected that the advantageous effect of the present invention is reduced by having more frequency bands in the hearing aid system than critical bands of the cochlea, because this will not allow the whole frequency range of the respective critical bands of the cochlea to be attenuated within the same switching period.

On the other hand it is also suspected to be less beneficial choice to have fewer frequency bands in the hearing aid system than critical bands of the cochlea, because this will prevent the whole frequency range of the respective critical bands of the cochlea to be attenuated within the same switching period because at least two frequency bands of the hearing aid system will cover a critical band of the cochlea, unless the number of critical bands of the cochlea is a multiple of the number of hearing aid frequency bands and if this is the case then full advantage of the frequency resolution capabilities of the cochlea is not obtained and the provided speech intelligibility provided to the hearing aid system user is therefore expected to be reduced.

If a hearing aid system comprises a number of frequency bands, which is much larger than the number of critical bands of the cochlea, then the hearing aid system will within the present context be considered to have a number of frequency bands that match the number of critical bands if the frequency bands of the hearing aid system are grouped (with respect to the manner of processing) such that the frequency bandwidths of the grouped frequency bands match those of the critical bands.

In a further variation of the embodiments of FIG. 1 and FIG. 2 the digital signal processor 105 is not adapted to compensate a hearing loss of an individual hearing aid user by providing for each frequency band an appropriate gain as a function of an input signal level and hearing threshold because the hearing aids according to the present invention may also provide improved speech intelligibility for individuals that don't have a traditional hearing loss that encompasses a lessened ability to hear sounds of low level (i.e. a raised hearing threshold). In other variations the digital signal processor 105 is additionally adapted to provide noise reduction and/or speech intelligibility enhancement in a multitude of manners all of which will be well known for a person skilled in the art.

In another variation of the embodiments of FIG. 1 and FIG. 2 not all the frequency bands of the two frequency groups need to be interleaved. A positive effect may still be achieved if some of the frequency bands, in at least one of the frequency groups, are adjacent, and within the present context this will still be construed to lie within the general concept of the first group of frequency bands comprising frequency bands that are interleaved with respect to frequency bands comprised in the second group of frequency bands.

In yet another variation of the embodiments of FIG. 1 and FIG. 2 the non-selected frequency bands are powered down, whereby the added advantage of reduced power consumption is achieved.

Figure 3:
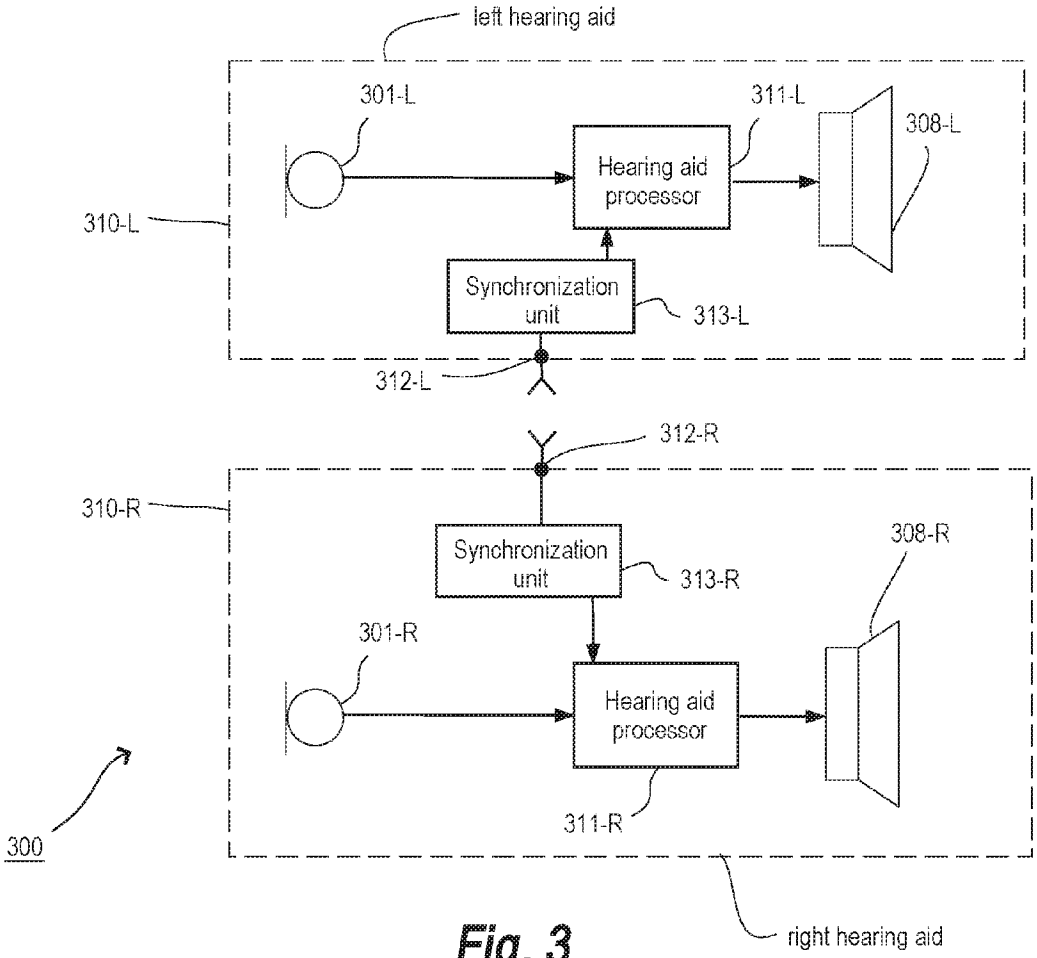
FIG. 3 illustrates highly schematically a binaural hearing aid system according to a third embodiment of the invention.

Reference is now made to FIG. 3, which illustrates highly schematically a binaural hearing aid system 300 according to a third embodiment of the invention. The binaural hearing aid system comprises a left hearing aid 310-L and a right hearing aid 310-R, and in the following the suffixes L and R will be used to denote components that are accommodated in respectively the left hearing aid 310-L and the right hearing aid 310-R. Each of the hearing aids 310-R and 310-L comprises an acoustical-electrical input transducer 301-R, 301-L, a hearing aid processor 311-L and 311-R, an antenna 312-L and 312-R for providing a bi-directional link between the two hearing aids, a synchronization unit 313-R and 313-L and an acoustic output transducer 308-L and 308-R.

The hearing aid processor 311-L and 311-R processes the input signal provided by the acoustical-electrical input transducer 310-R, 310-L in order to provide an output signal to the acoustic output transducer 308-L and 308-R in accordance with any one of the embodiments of FIG. 1 and FIG. 2 and their variations. The synchronization units 313-R and 313-L are adapted to synchronize the two hearing aids 310-R and 310-L of the binaural hearing aid system 300, using a bi-directional link comprising the antennas 312-L and 312-R, such that the timing of alternating between selecting the first group of frequency bands or the second group of frequency bands is such that the same group of frequency bands is not selected at the same time by the two hearing aids, whereby the user of the binaural hearing aid system continuously has access to the whole frequency spectrum of sounds from the sound environment.

In a variation of the binaural hearing aid system embodiment according to FIG. 3, the mod of alternating between selecting either the first or the second group of frequency bands is suspended whereby the selected frequency bands are kept fixed in both the hearing aids 310-R and 310-L, in such a way that the first group of frequency bands is selected in one of the hearing aids and the second group of frequency bands is selected in the other hearing aid.

Figure 4:
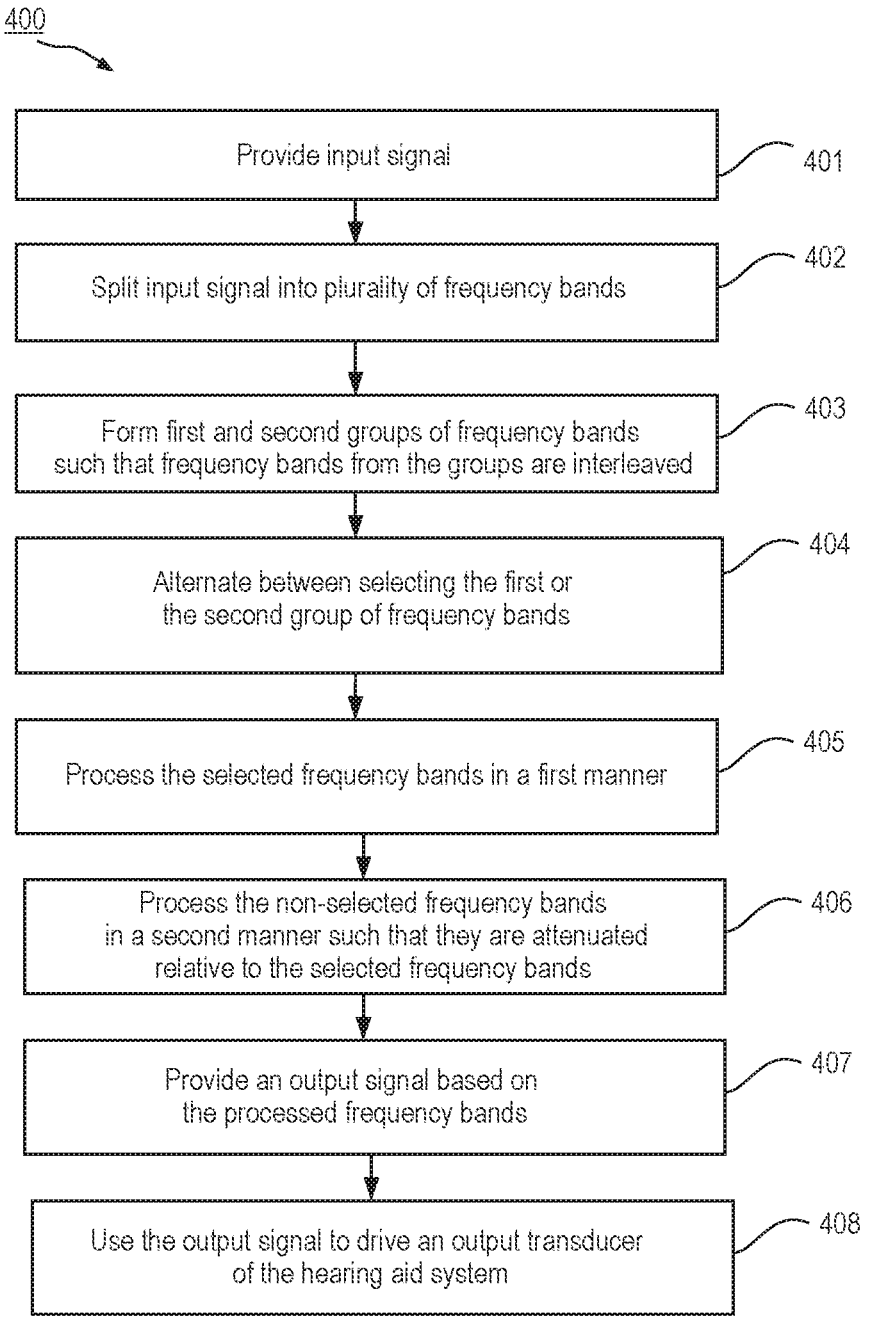
FIG. 4 illustrates a flow chart of a method according to an embodiment of the invention.

Reference is now made to FIG. 4 which illustrates highly schematically a method 400 of operating a hearing aid system according to an embodiment of the invention. The method comprises:

a first step 401 of providing an electrical input signal representing an acoustical signal from an input transducer of the hearing aid system;

a second step 402 of splitting the input signal into a plurality of frequency bands;

a third step 403 of forming a first group of frequency bands and a second group of frequency bands, wherein the first group of frequency bands comprises frequency bands that are interleaved with respect to frequency bands comprised in the second group of frequency bands;

a fourth step 404 of alternating between selecting the first group of frequency bands or the second group of frequency bands;

a fifth step 405 of processing the selected frequency bands in a first manner, hereby providing processed selected frequency bands;

a sixth step 406 of processing the non-selected frequency bands in a second manner such that the non-selected frequency bands are attenuated relative to the selected frequency bands, hereby providing processed non-selected frequency bands;

a seventh step 407 of providing an output signal based on the processed selected and non-selected frequency bands; and an eight step 408 using the output signal to drive an output transducer of the hearing aid system.

Yet another advantage of the various embodiments of the present invention is that the increased frequency selectivity achieved by alternatingly attenuating interleaved frequency bands will reduce masking effects.

Generally any of the disclosed embodiments of the invention may be varied by including one or more of the variations disclosed above with reference to another of the disclosed embodiments of the invention. Thus the disclosed method embodiment may also be varied by including one or more of the hearing aid system variations.

We claim:

1. A method of operating a hearing aid system comprising the steps of:

providing an electrical input signal representing an acoustical signal from an input transducer of the hearing aid system, splitting the input signal into a plurality of frequency bands, forming a first group of frequency bands and a second group of frequency bands that are mutually exclusive with respect to said first group of frequency bands, wherein the first group of frequency bands comprises frequency bands that are interleaved with respect to frequency bands comprised in the second group of frequency bands;

alternating between selecting the first group of frequency bands or the second group of frequency bands;

processing the selected frequency bands in a first manner, hereby providing processed selected frequency bands;

processing the non-selected frequency bands in a second manner such that the non-selected frequency bands are attenuated relative to the selected frequency bands, hereby providing processed non-selected frequency bands;

providing an output signal based on the processed selected and non-selected frequency bands; and using the output signal to drive an output transducer of the hearing aid system;

wherein the step of alternating between selecting the first group of frequency bands or the second group of frequency bands is only carried out in response to the steps of:

determining that speech is estimated to be present in the sound environment; and identifying a pause between syllables;

and wherein the step of identifying a pause between syllables comprises the further steps of:

providing an envelope of the electrical input signal;

estimating an envelope level of the electrical input signal; and determining that the estimated envelope level represents a pause between syllables in response to a multitude of consecutively estimated envelope levels being below a first threshold level for at least a first minimum duration of time, wherein the first minimum duration of time is selected from the range between 1 millisecond and 50 milliseconds or from the range between 1 millisecond and 10 milliseconds, or from the range between 1 millisecond and 5 milliseconds.

2. The method according to claim 1, wherein the step of forming a first and a second group of frequency bands comprises the further steps of:

numbering the plurality of frequency bands in consecutive order as a function of center frequency of the frequency bands;

defining the first group of frequency bands to comprise even numbered frequency bands; and defining the second group of frequency bands to comprise odd numbered frequency bands, such that the even and odd numbered frequency bands may be interleaved.

3. The method according to claim 1, wherein the step of alternating between selecting the first group of frequency bands or the second group of frequency bands is carried out with a switching period in the range between 100 milliseconds and 10 000 milliseconds, or 100 milliseconds and 300 milliseconds, or in the range between 150 milliseconds and 250 milliseconds.

4. The method according to claim 1, comprising the further step of:

identifying a pause between syllables only if a second minimum duration of time has passed since a previous determination of a pause between syllables and wherein said second minimum duration of time is in the range between 10 milliseconds and 10 000 milliseconds, or in the range between 100 milliseconds and 300 milliseconds, or in the range between 150 milliseconds and 250 milliseconds.

5. The method according to claim 1, comprising the further steps of:

determining if speech is present in the sound environment, and in case it is not:

processing the first group of frequency bands and the second group of frequency bands as if they were both selected.

6. The method according to claim 1, comprising the further steps of:

determining if speech is present in the sound environment, and in case it is not:

alternating between selecting the first group of frequency bands and the second group of frequency bands with a switching period in the range between 100 milliseconds and 10 000 milliseconds, or 100 milliseconds and 300 milliseconds, or in the range between 150 milliseconds and 250 milliseconds.

7. The method according to claim 1, wherein the non-selected frequency bands are attenuated relative to the selected frequency bands such that the acoustical output signal levels provided by the non-selected frequency bands are not within a range of output levels wherein a user of the hearing aid system suffers from an auditory neurodegeneration.

8. The method according to claim 1, wherein the non-selected frequency bands are attenuated such that the provided output level in dB SPL within a critical frequency band is below a threshold level selected from the range between 30 dB SPL and 50 dB SPL.

9. The method according to claim 1, wherein the step of processing the non-selected frequency bands in a second manner such that the non-selected frequency bands are attenuated relative to the selected frequency bands comprises the further step of inserting band-stop filters in the non-selected frequency bands.

10. The method according to claim 9, comprising the further step of inserting band-stop filters in the selected frequency bands in order to avoid signal spillover to neighboring frequency bands.

11. The method according to claim 1, wherein the plurality of frequency bands are selected to be in the in the range between 8 and 32, or in the range between 10 and 28.

12. A method of operating a hearing aid system comprising the steps of:

(a) providing an electrical input signal representing an acoustical signal from an input transducer of the hearing aid system, (b) splitting the input signal into a plurality of frequency bands, (c) forming a first group of frequency bands and a second group of frequency bands that are mutually exclusive with respect to said first group of frequency bands, wherein the first group of frequency bands comprises frequency bands that are interleaved with respect to frequency bands comprised in the second group of frequency bands;

(d) alternating between selecting the first group of frequency bands or the second group of frequency bands;

(e) processing the selected frequency bands in a first manner, hereby providing processed selected frequency bands;

(f) processing the non-selected frequency bands in a second manner such that the non-selected frequency bands are attenuated relative to the selected frequency bands, hereby providing processed non-selected frequency bands;

(g) providing an output signal based on the processed selected and non-selected frequency bands; and (h) using the output signal to drive an output transducer of the hearing aid system, wherein the hearing aid system comprises a first hearing aid and a second hearing aid, which both are adapted to carry out the steps (a)-(h) and comprising the further step of:

synchronizing the two hearing aids with respect to the timing of alternating between selecting the first group of frequency bands or the second group of frequency bands such that the same group of frequency bands is not selected at the same time by the two hearing aids.

13. A non-transitory computer-readable medium storing instructions thereon, which when executed by a computer perform a method comprising the steps of:

providing an electrical input signal representing an acoustical signal from an input transducer of a hearing aid system, splitting the input signal into a plurality of frequency bands, forming a first group of frequency bands and a second group of frequency bands that are mutually exclusive with respect to said first group of frequency bands, wherein the first group of frequency bands comprises frequency bands that are interleaved with respect to frequency bands comprised in the second group of frequency bands;

alternating between selecting the first group of frequency bands or the second group of frequency bands;

processing the selected frequency bands in a first manner, hereby providing processed selected frequency bands;

processing the non-selected frequency bands in a second manner such that the non-selected frequency bands are attenuated relative to the selected frequency bands, hereby providing processed non-selected frequency bands;

providing an output signal based on the processed selected and non-selected frequency bands; and using the output signal to drive an output transducer of the hearing aid system;

wherein the step of alternating between selecting the first group of frequency bands or the second group of frequency bands is only carried out in response to the steps of:

determining that speech is estimated to be present in the sound environment; and identifying a pause between syllables;

and wherein the step of identifying a pause between syllables comprises the further steps of:

providing an envelope of the electrical input signal;

estimating an envelope level of the electrical input signal; and determining that the estimated envelope level represents a pause between syllables in response to a multitude of consecutively estimated envelope levels being below a first threshold level for at least a first minimum duration of time, wherein the first minimum duration of time is selected from the range between 1 millisecond and 50 milliseconds or from the range between 1 millisecond and 10 milliseconds, or from the range between 1 millisecond and 5 milliseconds.

14. A hearing aid system comprising two hearing aids each comprising:

an input transducer adapted to provide an input signal;

a filter bank adapted to split the input signal into a plurality of frequency bands;

a frequency band selector adapted to provide a first group of frequency bands and a second group of frequency bands that are mutually exclusive with respect to said first group of frequency bands, wherein the first group of frequency bands comprises frequency bands that are interleaved with respect to frequency bands comprised in the second group of frequency bands, and adapted to select either the first or the second group of frequency bands;

a digital signal processor adapted for processing the selected frequency bands in a first manner, hereby providing processed selected frequency bands, and adapted for processing the non-selected frequency bands in a second manner such that the non-selected frequency bands are attenuated relative to the selected frequency bands, hereby providing processed non-selected frequency bands;

a timing circuit adapted to determine the timing of the frequency band selector to alternate between selecting the first group of frequency bands or the second group of frequency bands, wherein the timing circuits of the two hearing aids are synchronized with respect to the timing of alternating between selecting the first group of frequency bands or the second group of frequency bands such that the same group of frequency bands is not selected at the same time by the two hearing aids; and an output transducer adapted for providing an acoustical output signal based on the processed selected frequency bands and based on the processed non-selected frequency bands.

15. The hearing aid system according to claim 14, wherein the digital signal processor is further adapted to attenuate the non-selected frequency bands relative to the selected frequency bands in order to provide that the output signal level of the non-selected frequency bands are not within a range wherein the user suffers from an auditory neurodegeneration.

16. The hearing aid system according to claim 14, wherein the timing circuit is further adapted to only alternate between selecting the first group of frequency bands or the second group of frequency bands in response to a determination that speech is present in the sound environment; and in response to an identification of a pause between syllables.

* * * * *